US010373753B2

(12) United States Patent
Maeda et al.

(10) Patent No.: US 10,373,753 B2
(45) Date of Patent: Aug. 6, 2019

(54) MULTI-PHASE REACTOR CAPABLE OF OBTAINING CONSTANT INDUCTANCE FOR EACH PHASE

(71) Applicant: FANUC CORPORATION, Yamanashi (JP)

(72) Inventors: Takuya Maeda, Yamanashi (JP); Masatomo Shirouzu, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 52 days.

(21) Appl. No.: 15/354,022

(22) Filed: Nov. 17, 2016

(65) Prior Publication Data

US 2017/0154718 A1 Jun. 1, 2017

(30) Foreign Application Priority Data

Nov. 30, 2015 (JP) ..... 2015-232994

(51) Int. Cl.
*H01F 17/06* (2006.01)
*H01F 3/14* (2006.01)
*H01F 37/00* (2006.01)

(52) U.S. Cl.
CPC ..... *H01F 17/062* (2013.01); *H01F 3/14* (2013.01); *H01F 37/00* (2013.01)

(58) Field of Classification Search
CPC ..... H01F 27/00–36; H01F 17/062
USPC ..... 336/65, 83, 170, 173–174, 180–184, 336/220–223
See application file for complete search history.

(56) References Cited

U.S. PATENT DOCUMENTS 1,709,924 A * 4/1929 Thurston ..... B66B 1/08 318/827
2,406,704 A * 8/1946 Mossay ..... H01F 30/12 307/156
2,442,751 A * 6/1948 Abbott ..... H01F 29/10 336/135
4,482,945 A * 11/1984 Wolf ..... H01F 27/2823 336/183
6,873,237 B2 * 3/2005 Chandrasekaran ..... H01F 3/08 336/170
7,554,431 B2 * 6/2009 Dahlgren ..... H01F 27/255 336/233

(Continued)

FOREIGN PATENT DOCUMENTS

JP 5689228 U 7/1981
JP 61224306 A 10/1986

(Continued)

OTHER PUBLICATIONS

English Abstract and Machine Translation for Japanese Publication No. 02-203507 A, published Aug. 13, 1990, 7 pgs.

(Continued)

*Primary Examiner* — Tuyen T Nguyen
(74) *Attorney, Agent, or Firm* — Fredrikson & Byron, P.A.

(57) ABSTRACT

A multi-phase reactor is configured to include a first core arranged at a center of the reactor; a plurality of second cores provided outside the first core and arranged so that each of magnetic paths with respect to the first core is in a loop shape; and one or a plurality of windings wound around each of the second cores. With this configuration, the multi-phase reactor capable of setting a constant value of inductance for each phase is provided.

16 Claims, 12 Drawing Sheets

(56) References Cited

U.S. PATENT DOCUMENTS

| | | | | |
|---|---|---|---|---|
| 2003/0198067 | A1* | 10/2003 | Sun | H01F 3/08 363/53 |
| 2005/0030140 | A1 | 2/2005 | Dahlgren et al. | |
| 2008/0094159 | A1 | 4/2008 | Sodo | |
| 2015/0123479 | A1 | 5/2015 | Kurita | |
| 2016/0125998 | A1* | 5/2016 | Bhide | H01F 37/00 336/5 |

FOREIGN PATENT DOCUMENTS

| | | | |
|---|---|---|---|
| JP | 2203507 | A | 8/1990 |
| JP | 3502279 | A | 5/1991 |
| JP | 2007300700 | A | 11/2007 |
| JP | 2008177500 | A | 7/2008 |
| JP | 2010252539 | A | 11/2010 |
| JP | 201342028 | A | 2/2013 |
| JP | 201374084 | A | 4/2013 |
| JP | 201532814 | A | 2/2015 |
| WO | 2014033830 | A1 | 3/2014 |

OTHER PUBLICATIONS

English Abstract and Machine Translation for Japanese Publication No. 2008-177500 A, published Jul. 31, 2008, 18 pgs.
English Abstract and Machine Translation for Japanese Publication No. 2010-252539 A, published Nov. 4, 2010, 17 pgs.
English Abstract and Machine Translation for Japanese Publication No. 2013-074084 A, published Apr. 22, 2013, 15 pgs.
English Abstract and Machine Translation for Japanese Publication No. 2007-300700 A, published Nov. 15, 2007, 13 pgs.
English Abstract and Machine Translation for Japanese Publication No. 2015-032814 A, published Feb. 16, 2015, 20 pgs.
English Abstract and Machine Translation for Japanese Publication No. 2013-042028 A, published Feb. 28, 2013, 17 pgs.
English Machine Translation for Japanese Publication No. JPS56-089228 U, published Jul. 16, 1981, 4 pgs.
English Abstract and Machine Translation for Japanese Publication No. JPS61-224306 A, published Oct. 6, 1986, 5 pgs.
English Machine Translation for Japanese Publication No. JPH03-502279 A, published May 23, 1991, 4 pgs.

* cited by examiner

MULTI-PHASE REACTOR CAPABLE OF OBTAINING CONSTANT INDUCTANCE FOR EACH PHASE

BACKGROUND OF THE INVENTION

1. Field of the Invention

The present invention relates to a multi-phase reactor capable of obtaining a constant inductance for each phase.

2. Description of the Related Art

For example, a three-phase reactor has been conventionally used in an industrial robot, a machine tool, and so on in order to reduce a failure of an inverter and to improve a power factor by being disposed between a power-supply side (primary side) and the inverter or between a load side, such as a motor, (secondary side) and the inverter.

Specifically, a three-phase reactor is disposed on a primary side of an inverter to improve a power factor (for harmonics countermeasure) and to reduce a surge from a power supply. Alternatively, a three-phase reactor is disposed on a secondary side of an inverter to reduce a noise of a motor during operation of an inverter and to take a countermeasure against a surge. A description is given herein of mostly a three-phase reactor as an example. However, applications of the present invention are not limited to a three-phase reactor. The present invention may be a multi-phase reactor other than a three-phase reactor.

By the way, various multi-phase reactors have been conventionally proposed. For example, a three-phase reactor generally includes three cores (iron cores) and three windings (coils) wound around the cores. For example, Japanese Laid-Open Patent Publication No. H02(1990)-203507 (Patent Literature 1) discloses a three-phase reactor including three windings arranged in parallel.

Further, International Laid-open Patent Publication No. WO 2014/033830 (Patent Literature 2) discloses an arrangement of central axes of a plurality of respective windings around a central axis of a three-phase reactor. This arrangement is considered as being obtained by arranging the three winding portions in Patent Literature 1 at vertex positions of an equilateral triangle, rather than arranging the three winding portions in a row.

Further, Japanese Laid-open Patent Publication No. 2008-177500 (Patent Literature 3) discloses a variable reactor capable of varying a reactor which includes six linear magnetic cores arranged in a radial direction, coupling magnetic cores coupling the linear magnetic cores, and windings wound around the linear magnetic cores and the coupling magnetic cores. In addition, no gap portion is provided in order to make a reactance variable.

For example, a conventional three-phase reactor generally includes three cores (winding cores) around which windings are respectively wound, and which are arranged in a row between an upper core and a lower core, with predetermined gaps provided with respect to the lower core. Such a three-phase reactor is line-symmetric with respect to a central line of, for example, a center winding core.

However, a line-symmetric three-phase reactor formed of three winding cores undergoes the imbalance between a center winding core (winding) and winding cores at opposite ends. Thus, this is a problem in that it is difficult to set a constant value of inductance for three phases, namely, R-phase, S-phase, and T-phase.

In light of the above-described problem in the related art, the present invention aims to provide a multi-phase reactor capable of setting a constant value of inductance for each phase.

SUMMARY OF INVENTION

According to a first aspect of the present invention, there is provided a multi-phase reactor including a first core arranged at a center of the reactor; a plurality of second cores provided outside the first core and arranged so that each of magnetic paths with respect to the first core is in a loop shape; and one or a plurality of windings wound around each of the second cores.

The second cores may have an identical shape. Note that the second cores may be arranged around the first core in rotational symmetry with respect to a center of the first core. Further, predetermined gaps may be provided between outside of the first core and the second cores. The multi-phase reactor may further include a gap member provided between outside of the first core and the second cores and having a predetermined thickness.

Each of the second cores may be formed integrally including two radial legs each having one end facing outside of the first core and extending radially, and a peripheral portion connecting other ends of the two radial legs, and each of the windings may be wound around a corresponding one of the radial legs. The outside of the first core may have a circular shape or a polygonal shape corresponding to a shape at the one end of each of the radial legs of the plurality of second cores.

The multi-phase reactor may further include core fixing members respectively provided between the peripheral portions of adjacent two of the second cores. The core fixing members may be made of a quality of a material different from that of the plurality of second cores. The core fixing members may be formed integrally with the plurality of second cores with an identical quality of a material. The core fixing members and the peripheral portions of the second cores may be formed as a circular shape.

The core fixing members may be used for assembling or fixing the multi-phase reactor. Each of the core fixing members may include a predetermined hole. The multi-phase reactor may be a three-phase reactor to which a three-phase alternating current is applied. The plurality of second cores of an integral multiple of three may be provided, and the windings wound around the second cores of the integral multiple of three may be sorted into three.

BRIEF DESCRIPTION OF THE DRAWINGS

The present invention will be more clearly understood by reference to the accompanying drawings, in which.

DETAILED DESCRIPTION

Figure 12:
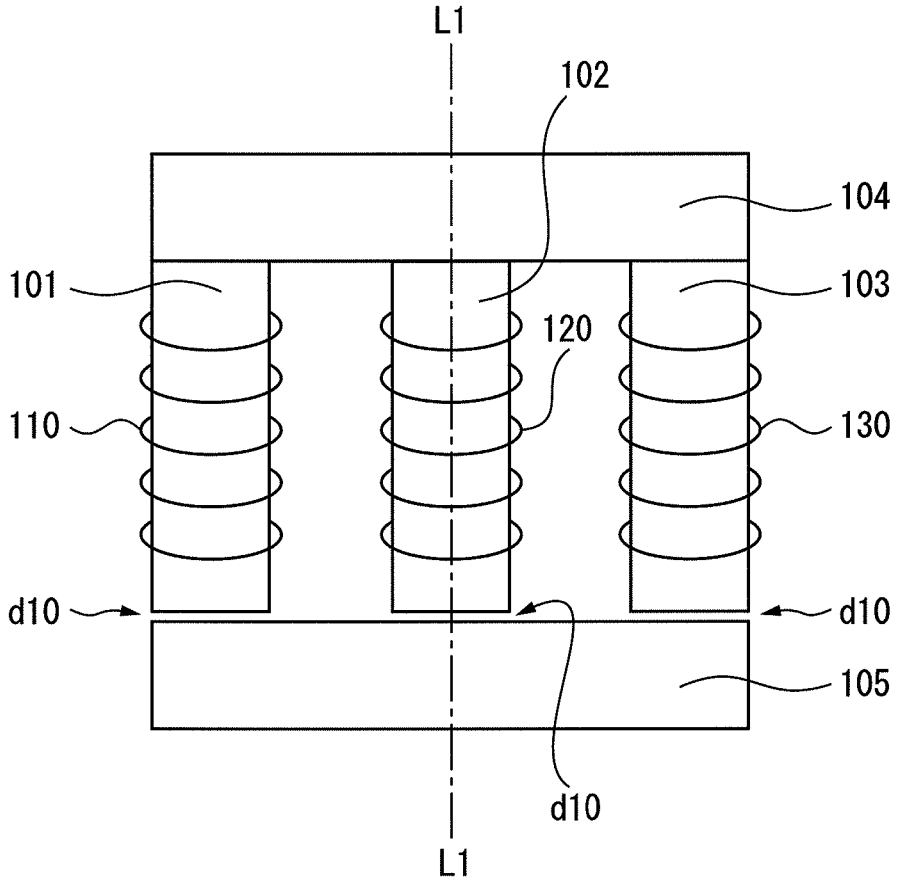
FIG. 12 is a view for illustrating an example of a conventional multi-phase reactor.

Prior to describing the details of examples of a multi-phase reactor according to the present invention, an example of a conventional multi-phase reactor and a problem thereof are firstly described with reference to FIG. 12. FIG. 12 is a view for illustrating an example of a conventional multi-phase reactor, and illustrating an example of a three-phase reactor.

As illustrated in FIG. 12, the three-phase reactor includes an upper core 104, a lower core 105, and three winding cores 101 to 103 around which windings 110 to 130 for R-phase, S-phase, and T-phase are respectively wound.

The winding cores 101 to 103 are arranged between the upper core 104 and the lower core 105 with gaps d10 provided respectively. For example, the winding 110 is wound around the winding core 101 for R-phase, the winding 120 is wound around the winding core 102 for S-phase, and the winding 130 is wound around the winding core 103 for T-phase.

In order to make an inductance constant for each of R-phase, S-phase, and T-phase, for example, the winding cores 101 to 103 have an identical quality of a material, an identical shape, and an identical width, and the winding cores 101 to 103 are arranged at an equal interval. Further, the windings 110 to 130 have an identical number of turns, an identical quality of a wire rod, an identical width, and the like.

In other words, in a side view as illustrated in FIG. 12, the winding cores 101 to 103 around which the windings 110 to 130 are wound are line-symmetric with respect to a line L1-L1 vertically connected through a center of the center winding core 102.

However, the three-phase reactor which is line-symmetric with respect to the line L1-L1 as illustrated in FIG. 12 inevitably undergoes the imbalance between the center winding core 102 (winding 120) and the winding cores 101 and 103 (windings 110 and 130) at opposite ends. Hence, this is a problem in that it is difficult to set a constant value of inductance for R-phase, S-phase, and T-phase.

Hereinafter, examples of a multi-phase reactor according to the present invention are described in detail with reference to the accompanying drawings. In the following, a three-phase reactor is described as an example. However, applications of the present invention are not limited to a three-phase reactor. The present invention is widely applicable to a multi-phase reactor which may require a constant inductance for each phase. In addition, the multi-phase reactor according to the present invention is applicable to a variety of equipment, without limitation to equipment which is provided on a primary side and a secondary side of an inverter in an industrial robot and a machine tool.

Figure 1:
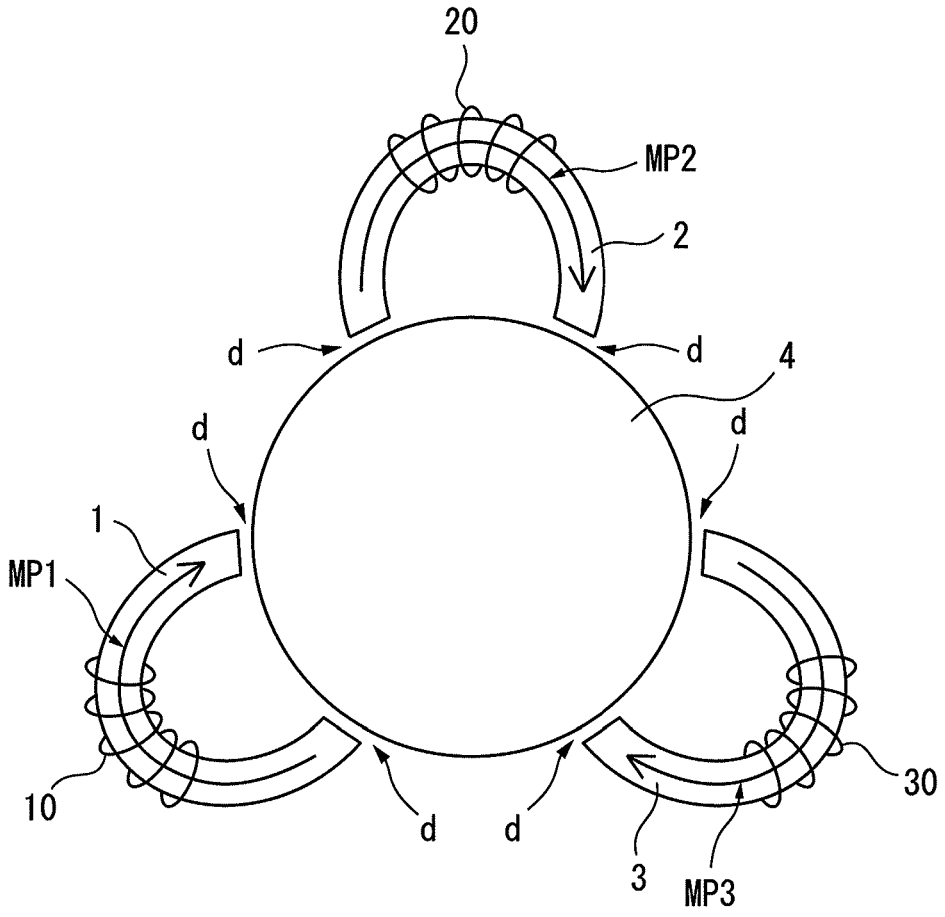
FIG. 1 is a view for illustrating a first example of a multi-phase reactor according to the present invention.

FIG. 1 is a view for illustrating a first example of a multi-phase reactor according to the present invention, and schematically illustrating an example of a three-phase reactor to which a three-phase alternating current is applied. In FIG. 1, reference numeral 1 indicates a core (winding core: second core) for R-phase in a three-phase alternating current (R-phase, S-phase, and T-phase), reference numeral 2 indicates a winding core (second core) for S-phase, reference numeral 3 indicates a winding core (second core) for T-phase, and reference numeral 4 indicates a central core (first core).

In addition, reference numeral 10 indicates a winding wound around the core 1 for R-phase, reference numeral 20 indicates a winding wound around the core 2 for S-phase, and reference numeral 30 indicates a winding wound around the core 3 for T-phase. In other words, the three-phase (multi-phase) reactor of the first example includes a central core 4, three winding cores 1, 2, and 3 provided outside the central core 4, and three windings 10, 20, and 30 respectively wound around the three winding cores 1, 2, and 3.

The three winding cores 1, 2, and 3 are arranged so that each of magnetic paths MP1, MP2, and MP3 of the winding cores is in a loop shape with respect to the central core 4. In addition, gaps d are provided between outside of the central core 4 and opposite ends of each of the winding cores 1, 2, and 3. When a reactor is considered as a magnetic circuit, the provision of the gaps d normally causes the magnetic resistance of the gaps d to be a dominant element for an inductance of a reactor, and hence an inductance value is determined according to the gaps d. Generally, the inductance value becomes constant even at a large current. Meanwhile, when the gaps d are made to be small or zero, the magnetic resistance of an iron or an electromagnetic steel sheet constituting an iron core becomes a dominant element for an inductance, and hence generally, such a reactor is mainly for a low-current time. In addition, such a reactor also has a considerably different dimension.

In addition, the winding cores 1, 2, and 3 have an identical shape. In addition, a distance between adjacent two of the winding cores (1 and 2, 2 and 3, and 3 and 1) is equal to that between other adjacent two of the winding cores. In other words, the three winding cores 1, 2, and 3 are arranged around the central core 4 in rotational symmetry with respect to a center of the central core 4. In view of the provision of an inductance as the reactor, the winding cores 1, 2, and 3 need not have an identical shape, and there is no physical problem even when the winding cores 1, 2, and 3 are not arranged in rotational symmetry. Further, it is of course that there is no physical problem even when the winding cores 1, 2, and 3 do not have an identical size of the gaps d.

Further, the three winding cores 1, 2, and 3 can be formed using an identical material (e.g., can be formed by laminating electromagnetic steel sheets such as silicon steel sheets). In addition, the three windings 10, 20, and 30 have an identical quality of a wire rod and an identical width, as well as an identical number of turns, an identical winding interval, and the like. The winding cores 1, 2, and 3 and the central core 4 can be formed by applying various known core materials and core shapes. This results in the three winding cores 1, 2, and 3 (three windings 10, 20, and 30) being formed as equivalents to one another having an identical inductance value. In addition, likewise, the provision of gaps in the three winding cores 1, 2, and 3 results in the three winding cores 1, 2, and 3 having an identical inductance value. Gaps are provided within a magnetic path of the central core 4, and in addition, gaps are not provided in some cases, as has been described above. There is no physical problem even when the three windings 10, 20, and 30 do not have an identical number of turns and the like, similarly to the winding cores 1, 2, and 3.

Figure 2:
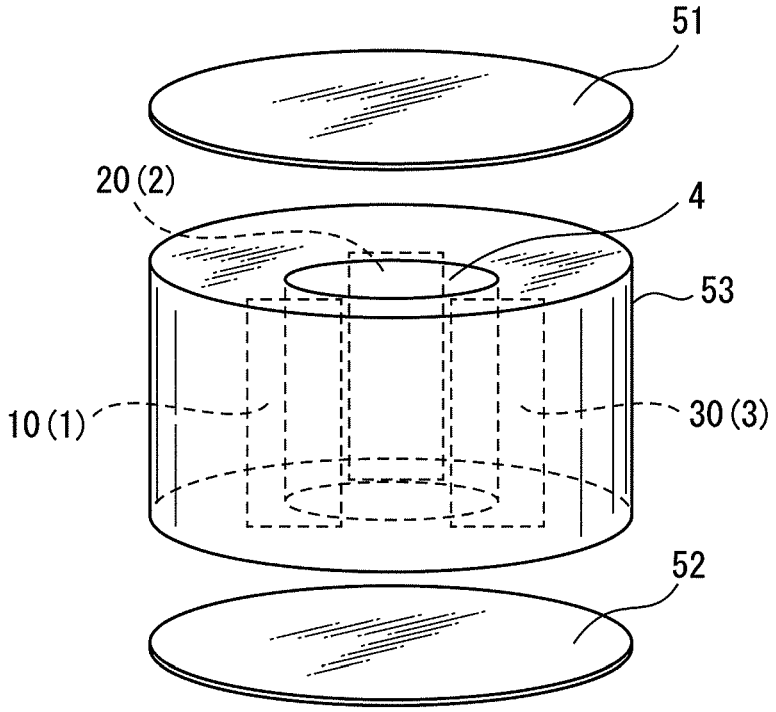
FIG. 2 is a perspective view schematically illustrating the multi-phase reactor of the first example illustrated in FIG. 1.

FIG. 2 is a perspective view schematically illustrating the multi-phase reactor of the first example illustrated in FIG. 1, and schematically illustrating the three-phase reactor illustrated in FIG. 1. As illustrated in FIG. 2, the three-phase reactor including the central core 4 and the three windings 10, 20, and 30 (three winding cores 1, 2, and 3) is held by, for example, an upper plate 51, a lower plate 52, and a case 53. It is of course that, for example, the upper plate 51, the lower plate 52, and the case 53 may be provided with a member (not illustrated) for holding and fixing the positional relationship between the central core 4 and the three winding cores 1, 2, and 3 while keeping the gaps d. Alternatively, it is of course that the upper plate 51, the lower plate 52, and the case 53 may be formed with a heat dissipation slit (not illustrated) and the like for dissipating heat from the three-phase reactor in use.

Figure 3:
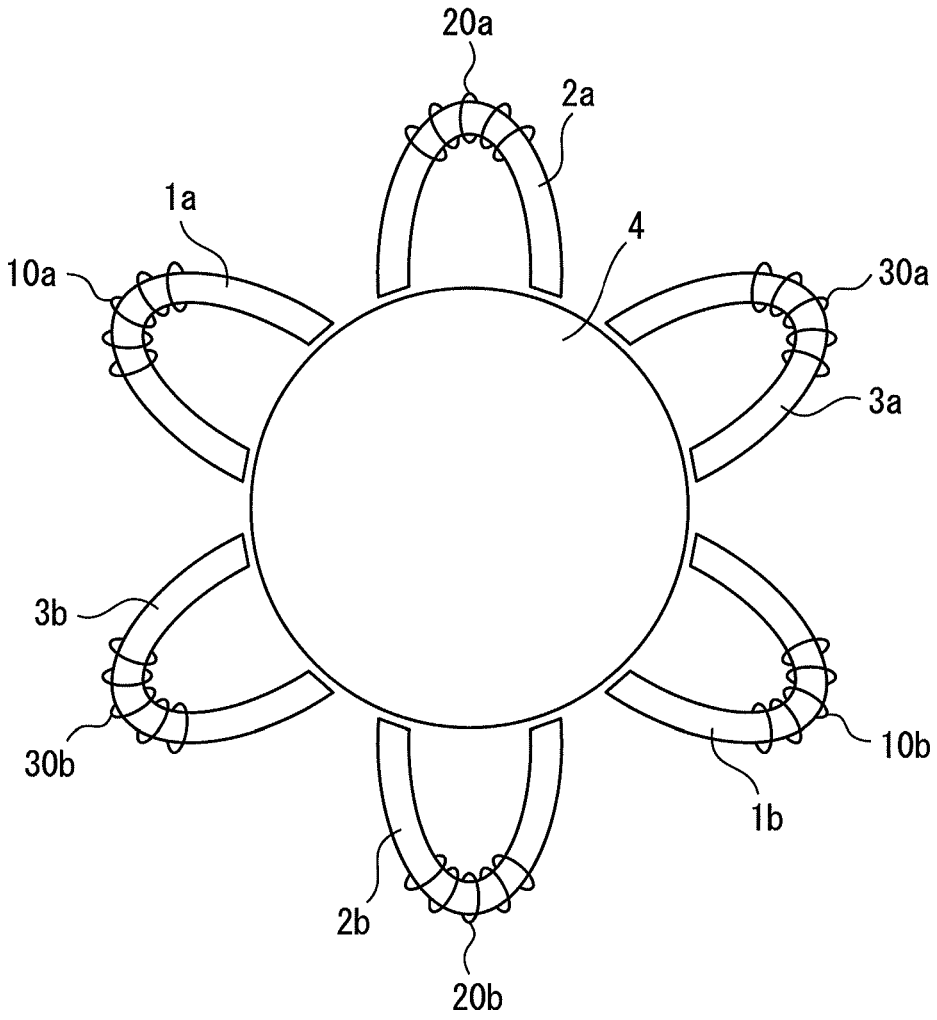
FIG. 3 is a view for illustrating a second example of the multi-phase reactor according to the present invention.

FIG. 3 is a view for illustrating a second example of the multi-phase reactor according to the present invention, and illustrating an example of a three-phase reactor which is formed of six winding cores 1*a*, 2*a*, 3*a*, 1*b*, 2*b*, and 3*b* (six windings 10*a*, 20*a*, 30*a*, 10*b*, 20*b*, and 30*b*) arranged around a central core 4 in rotational symmetry.

In other words, as illustrated in FIG. 3, the multi-phase reactor of the second example is, for example, a three-phase reactor which is formed of three sets of the windings 10*a* and 10*b*, 20*a* and 20*b*, and 30*a* and 30*b* wound around the two winding cores 1*a* and 1*b*, 2*a* and 2*b*, and 3*a* and 3*b* which are positioned on opposite sides of the central core 4, respectively in association with R-phase, S-phase, and T-phase. It is needless to say that the direction of turns, the connection, and the like of each of the windings are all the same in each set of the two windings 10*a* and 10*b*, 20*a* and 20*b*, and 30*a* and 30*b*.

In this manner, for example, a three-phase reactor is provided with winding cores of an integral multiple of three (in FIG. 3, twice of three), and the windings 10*a*, 20*a*, and 30*a*, and 10*b*, 20*b*, and 30*b* wound around the winding cores 1*a*, 2*a*, and 3*a*, and 1*b*, 2*b*, and 3*b* of the integral multiple of three are sorted into three, R-phase, S-phase, and T-phase. The multi-phase reactor illustrated in FIG. 3 can also be used as a six-phase reactor with the six windings 10*a*, 20*a*, 30*a*, 10*b*, 20*b*, and 30*b* being independent from one another as is, rather than forming sets of two windings.

Figure 4:
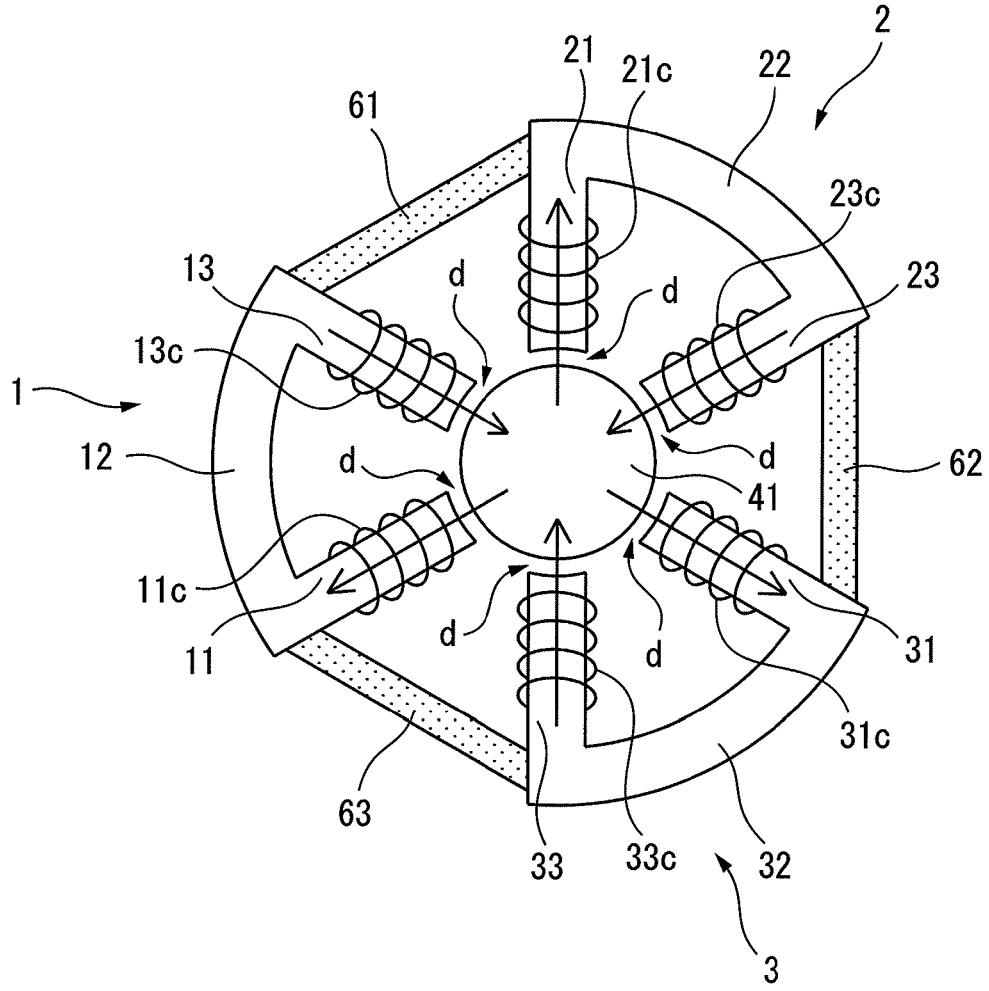
FIG. 4 is a view for illustrating a third example of the multi-phase reactor according to the present invention.

FIG. 4 is a view for illustrating a third example of the multi-phase reactor according to the present invention, and schematically illustrating an example of a three-phase reactor. As is apparent from a comparison between FIG. 4 and FIG. 1 described above, in the three-phase reactor of the third example, each of winding cores (second cores) 1, 2, and 3 includes two radial legs 11 and 13, 21 and 23, and 31 and 33 each having one end facing outside of a circular-shaped central core (first core) 41 and extending radially, and a peripheral portion 12, 22, and 32 connecting other ends of the two radial legs.

An end face at the one end of each of the radial legs 11 and 13, 21 and 23, and 31 and 33 has a circular arc shape corresponding to the circumference of the circular-shaped central core 42. In addition, certain gaps d are provided between the one ends of the respective radial legs and the circumference of the central core 41.

Core fixing members 61, 62, and 63 are provided respectively between the peripheral portions 12, 22, and 32 of adjacent two of the winding cores 1, 2, and 3. In other words, the core fixing member 61 is provided between the peripheral portion 12 of the winding core 1 and the peripheral portion 22 of the winding core 2; the core fixing member 62 is provided between the peripheral portion 22 of the winding core 2 and the peripheral portion 32 of the winding core 3; and the core fixing member 63 is provided between the peripheral portion 32 of the winding core 3 and the peripheral portion 12 of the winding core 1.

Windings 11*c* and 13*c* (21*c* and 23*c*, and 31*c* and 33*c*) are wound around the two radial legs 11 and 13 (21 and 23, and 31 and 33) of the winding core 1 (2, and 3). The direction of turns, the connection, and the like of the windings 11*c* and 13*c*, 21*c* and 23*c*, and 31*c* and 33*c* are all the same in each of the winding cores 1, 2, and 3.

The core fixing members 61, 62, and 63 are to be substantially separated from magnetic fluxes of the winding cores 1, 2, and 3 around which the windings are wound, as will be described later in detail with reference to FIG. 8 to FIG. 11B. Thus, the core fixing members 61, 62, and 63 need not be made of an identical quality of a material as that of the winding cores (e.g., an electromagnetic steel sheet), and can be made of a quality of a material such as plastic. Further, the core fixing members 61, 62, and 63, for example, can form predetermined holes (610, 620, and 630) thereon, and the holes can be used for fixing the three-phase reactor. In addition, the core fixing members 61, 62, and 63 can also be used to assemble the three-phase reactor.

Figure 5:
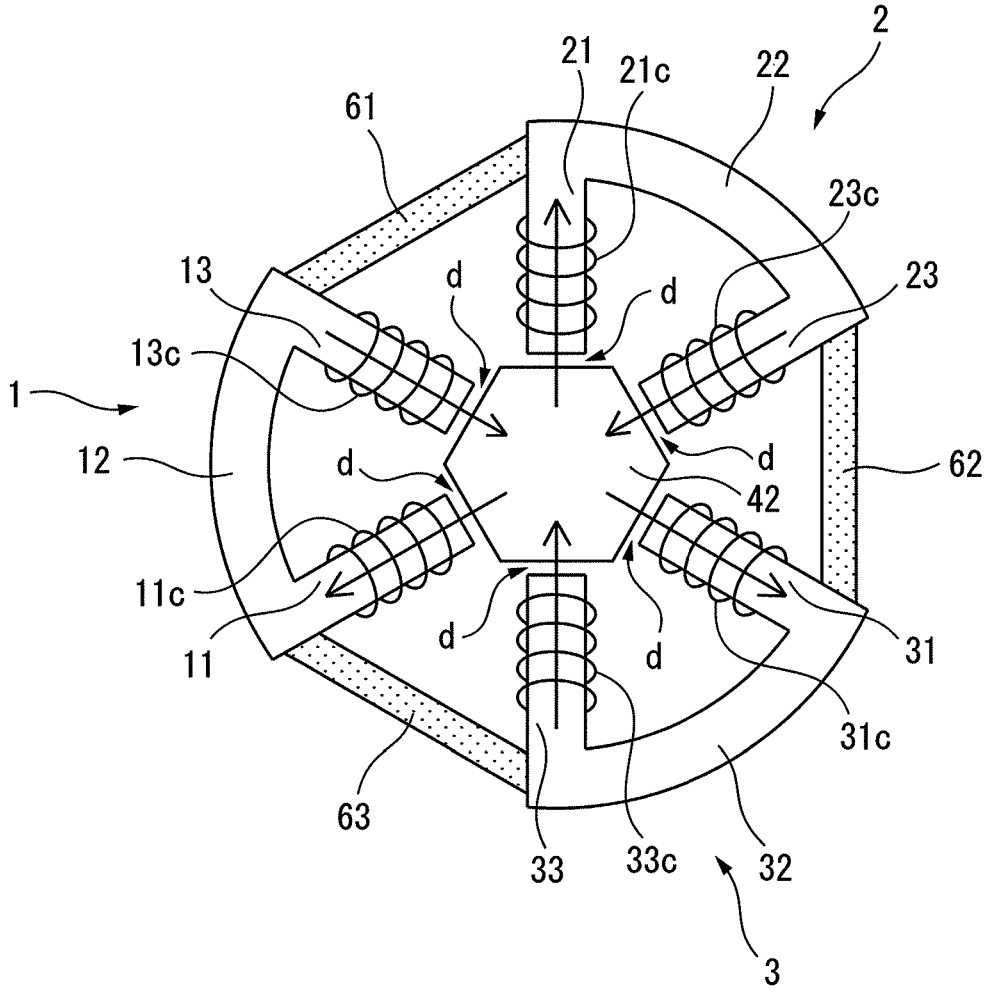
FIG. 5 is a view for illustrating a fourth example of the multi-phase reactor according to the present invention.

FIG. 5 is a view for illustrating a fourth example of the multi-phase reactor according to the present invention, in which a shape of a central core is different from that in the above-described third example. In other words, as illustrated in FIG. 5, in a three-phase reactor of the fourth example, an outer shape of a central core 42 is a regular hexagon (hexagon) corresponding to a shape at one end of each of radial legs 11 and 13, 21 and 23, and 31 and 33 of three winding cores 1, 2, and 3. An end face at the one end of each of the radial legs has a linear shape corresponding to each of sides of the regular hexagon-shaped central core 42. In addition, certain gaps d are provided between the one ends of the respective radial legs and the corresponding sides of the central core 42.

In this manner, a central core can be made into various shapes, such as a circular shape and a polygonal shape, based on the number of winding cores, the shape of the winding cores, and the like. When a central core is made of an electromagnetic steel sheet such as a silicon steel sheet, the central core may be formed by, for example, laminating electromagnetic steel sheets having an identical shape in a thickness direction (e.g., in a height direction in FIG. 2). However, a central core can be formed using a cut core and the like as long as offering the same condition (that the symmetry is not lost) to respective winding cores.

Figure 6:
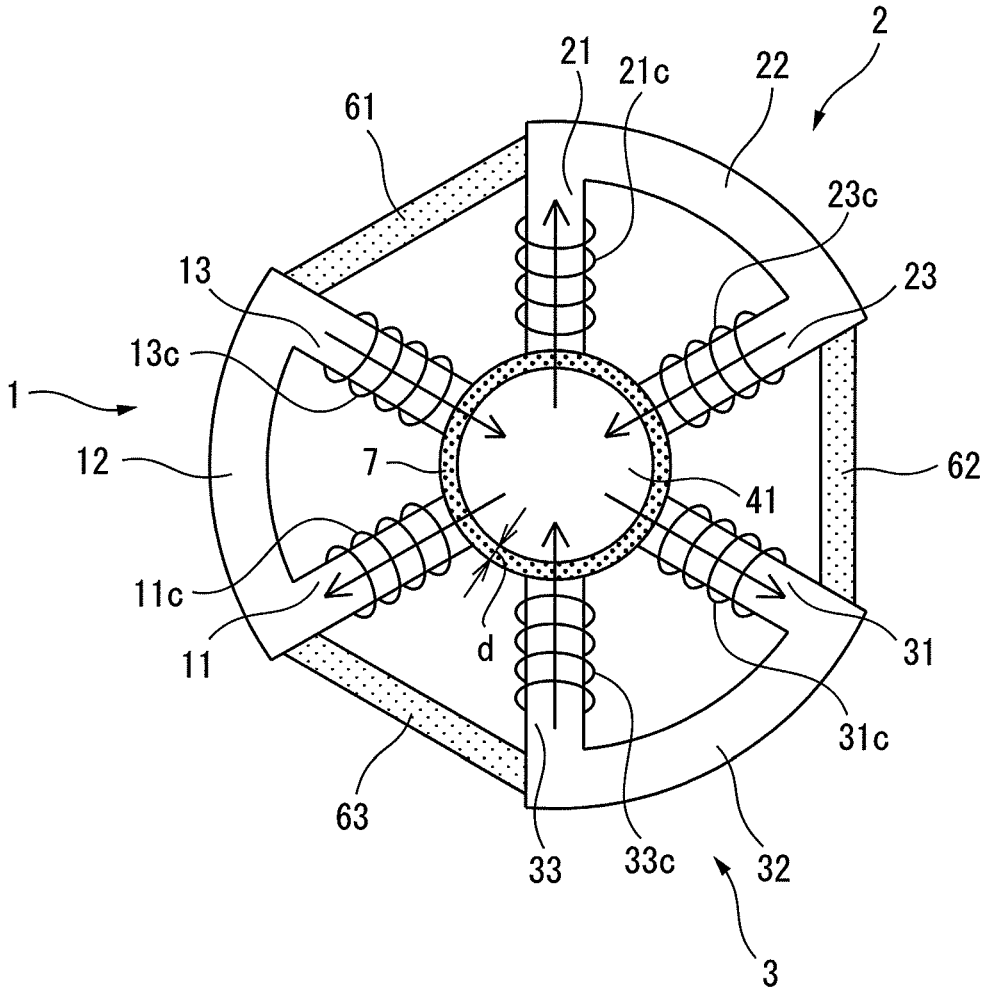
FIG. 6 is a view for illustrating a fifth example of the multi-phase reactor according to the present invention.

FIG. 6 is a view for illustrating a fifth example of the multi-phase reactor according to the present invention, in which a gap member 7 having a thickness of d is provided to the third example described with reference to FIG. 4. In other words, the gap member 7, for example, may have a cylindrical shape having a thickness of d in such a manner as to enclose the outside of the cylindrical-shaped central core 41. One end of each of the radial legs 11 and 13, 21 and 23, and 31, and 33 of the winding cores 1, 2, and 3 may be closely attached to outside of the gap member 7.

For example, when the central core 41 is formed by laminating circular electromagnetic steel sheets, a plurality of laminated circular electromagnetic steel sheets are to be held by the gap member 7. In addition, a gap d between the central core 41 and each of the winding cores 1, 2, and 3 can be defined by a thickness of the gap member 7. Thus, this enables to reduce the burden of assembling work of a reactor and obtain stable reactor characteristics. In addition, various materials, such as plastic, are applicable as the gap member 7.

In the third to fifth examples illustrated in FIG. 4 to FIG. 6, when the core fixing members 61, 62, and 63 are made of a material, such as plastic, which is different from that of the winding cores 1, 2, and 3, holes can be formed on the core fixing members 61, 62, and 63, and the holes can be used for assembling or fixing the three-phase reactor.

Figure 7:
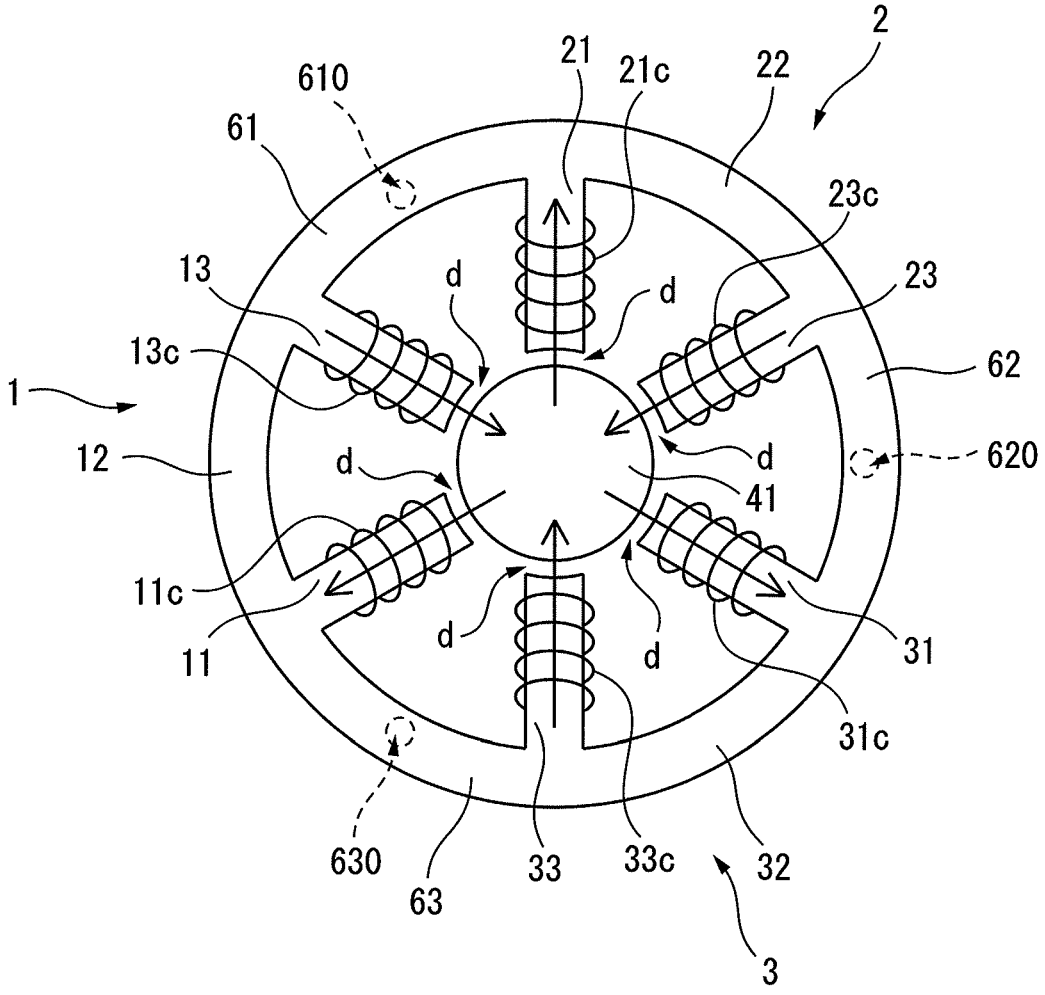
FIG. 7 is a view for illustrating a sixth example of the multi-phase reactor according to the present invention.
Figure 8:
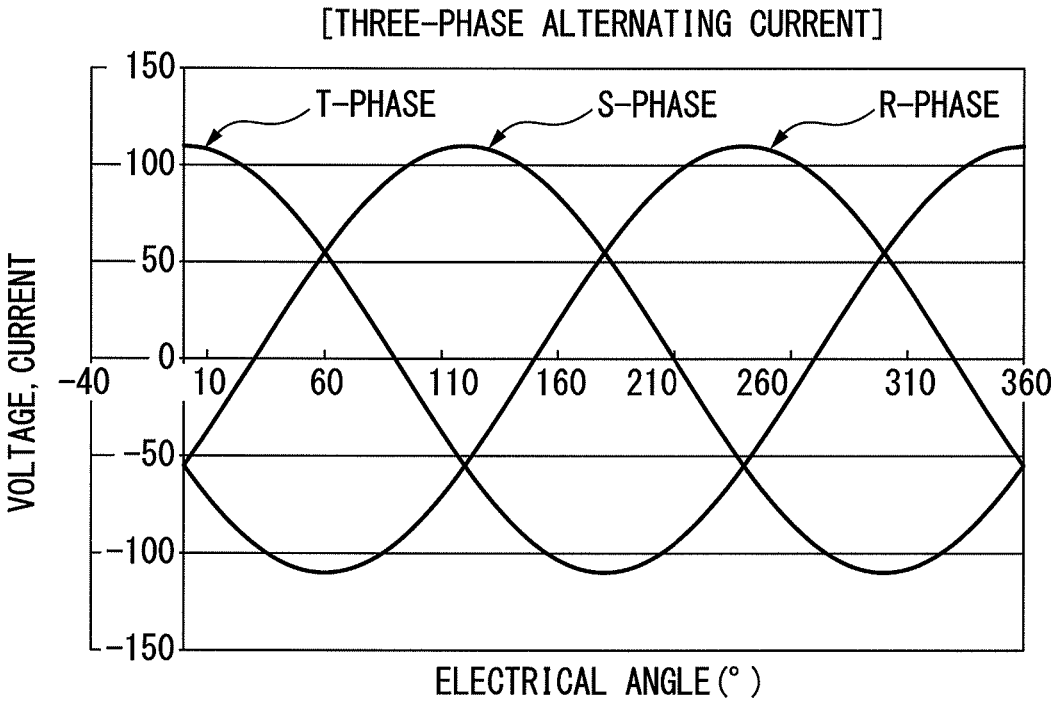
FIG. 8 is a waveform chart illustrating an example of a three-phase alternating current to be applied to the multi-phase reactor illustrated in FIG. 7.

FIG. 7 is a view for illustrating a sixth example of the multi-phase reactor according to the present invention, in which the core fixing members 61, 62, and 63 and the winding cores 1, 2, and 3 of the third example described with reference to FIG. 4 are formed integrally. FIG. 8 is a waveform chart illustrating an example of a three-phase alternating current to be applied to the multi-phase reactor illustrated in FIG. 7. In the multi-phase reactor illustrated in FIG. 7, the peripheral portion 12, 22, and 32 and the core fixing members 61, 62, and 63 are in an identical cylindrical shape.

As described with reference to FIG. 4, the windings 11*c* and 13*c* (21*c* and 23*c*, and 31*c* and 33*c*) are respectively wound around the two radial legs 11 and 13 (21 and 23, and 31 and 33) of each of the winding cores 1 (2, and 3). The direction of turns, the connection, and the like of the windings 11*c* and 13*c*, 21*c* and 23*c*, and 31*c* and 33*c* are all the same.

A three-phase alternating current for R-phase, S-phase, and T-phase with a phase (electrical angle) difference of 120°, as illustrated in FIG. 8, is flowed through the windings 11*c* and 13*c*, 21*c* and 23*c*, and 31*c* and 33*c* of each of the winding cores 1, 2, and 3. This generates a magnetic field as will be described with reference to FIG. 9A to FIG. 11B. FIG. 9A to FIG. 11B are diagrams for illustrating the operation of the multi-phase reactor illustrated in FIG. 7, and illustrating the three-phase reactor of the sixth example illustrated in FIG. 7 when being applied with the three-phase alternating current illustrated in FIG. 8.

Figure 9A:
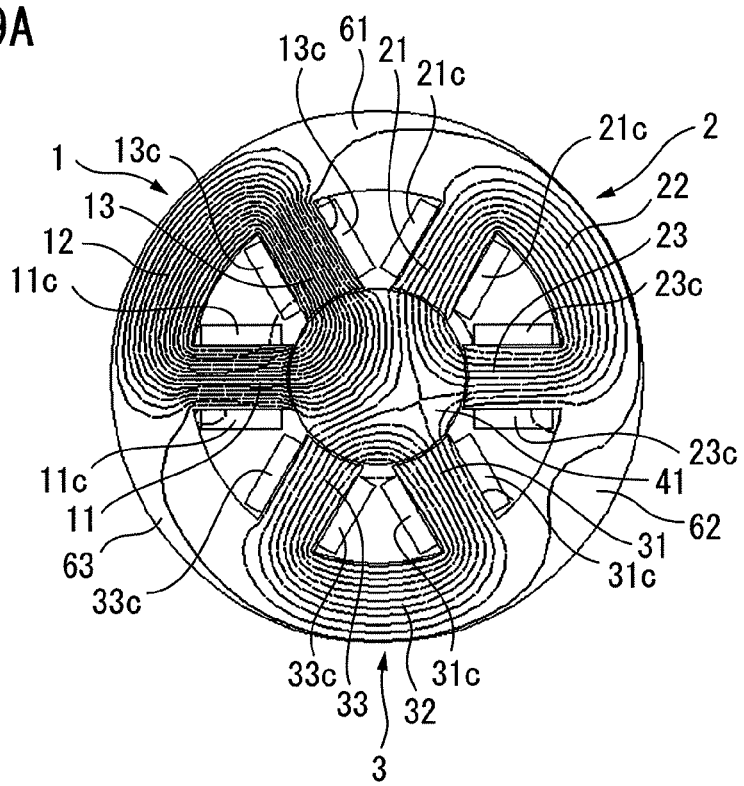
FIG. 9A and FIG. 9B are diagrams (No. 1) for illustrating the operation of the multi-phase reactor illustrated in FIG. 7.
Figure 9B:
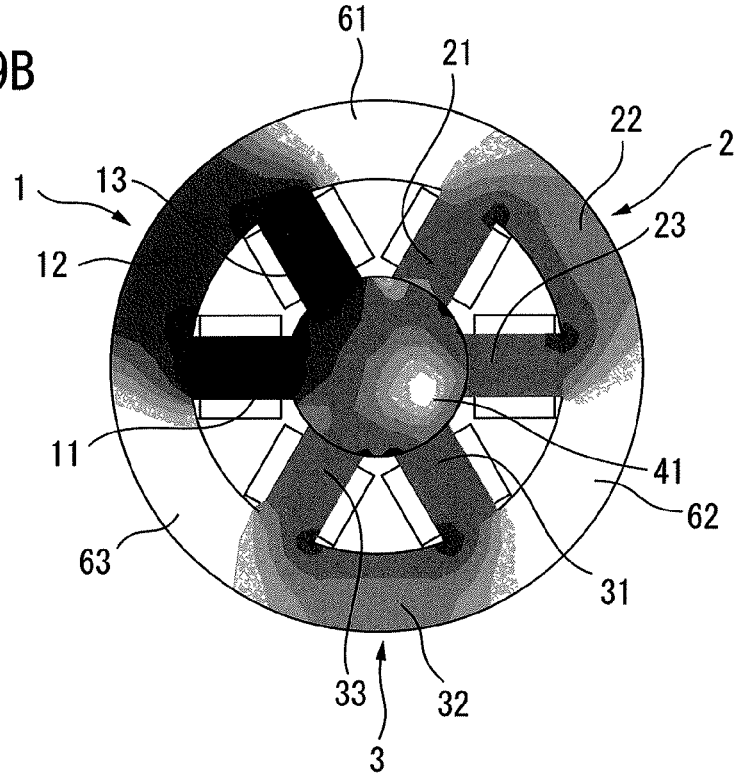
Figure 10A:
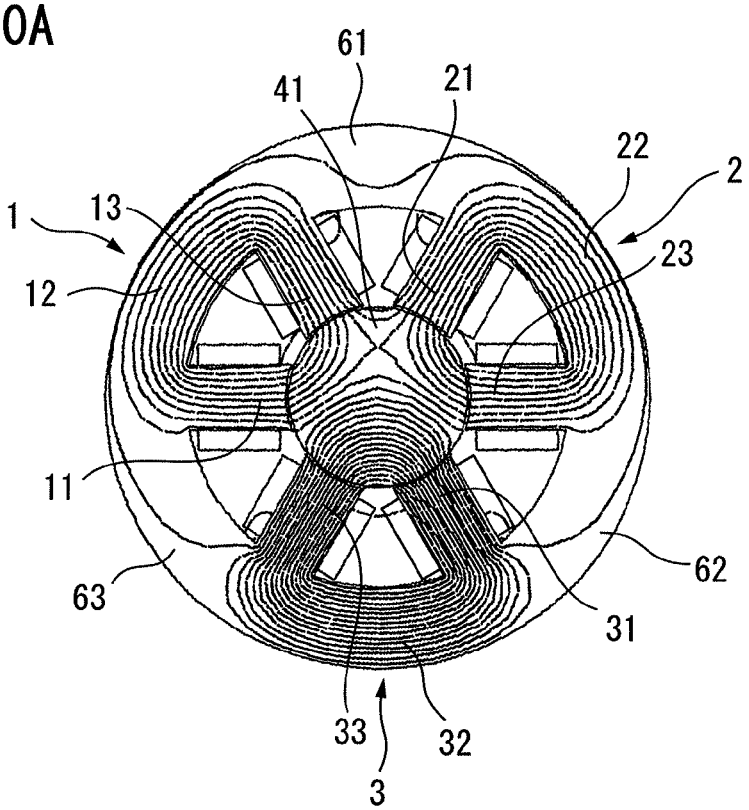
FIG. 10A and FIG. 10B are diagrams (No. 2) for illustrating the operation of the multi-phase reactor illustrated in FIG. 7.
Figure 10B:
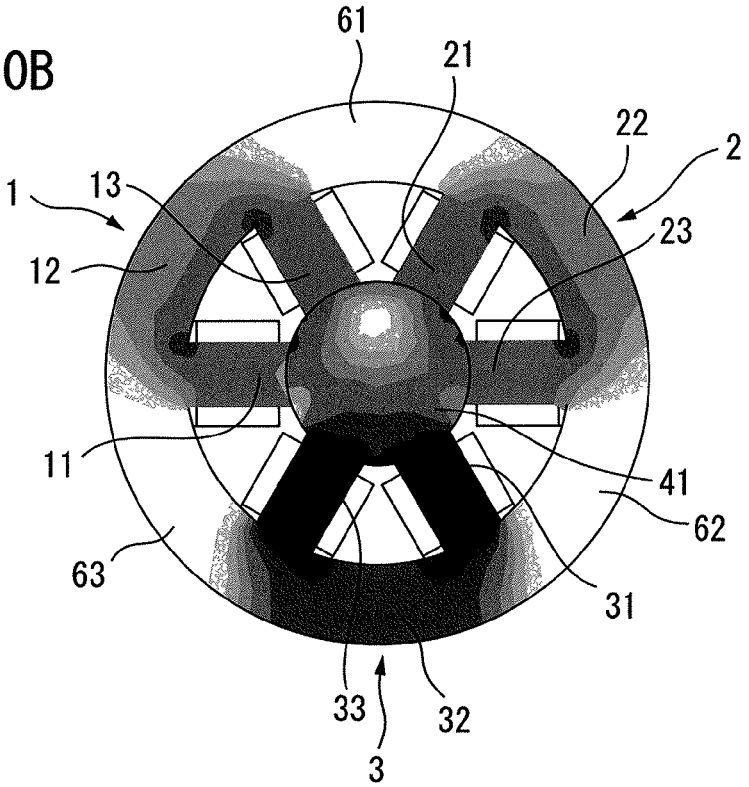
Figure 11A:
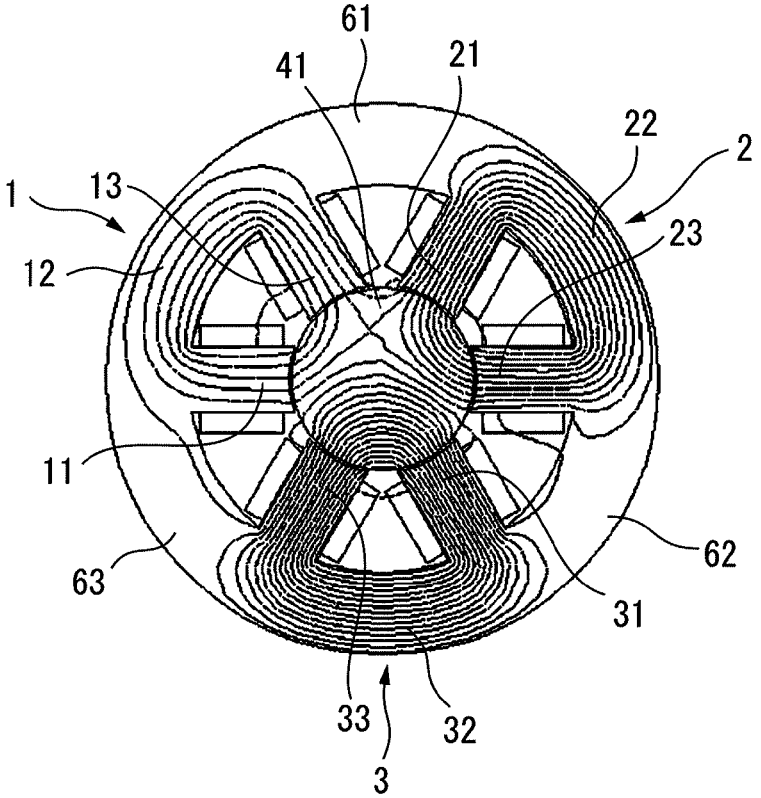
FIG. 11A and FIG. 11B are diagrams (No. 3) for illustrating the operation of the multi-phase reactor illustrated in FIG. 7.
Figure 11B:
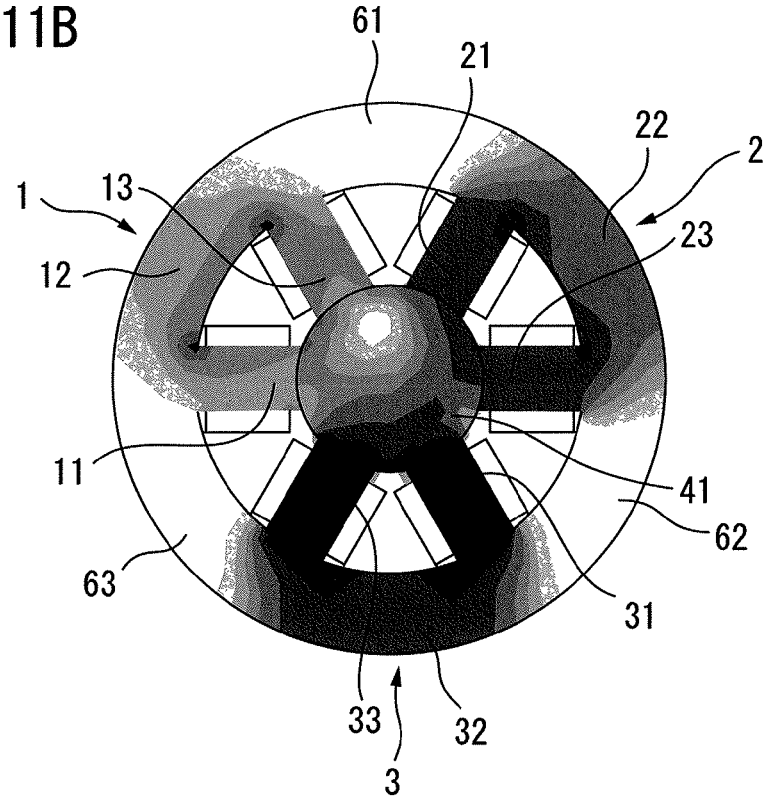

FIG. 9A and FIG. 9B illustrate when an electrical angle of a three-phase alternating current (voltage, current) in the waveform chart illustrated in FIG. 8 is 0°. FIG. 10A and FIG. 10B illustrate when an electrical angle is 60°. FIG. 11A and FIG. 11B illustrate when an electrical angle is 250°. In addition, FIG. 9A, FIG. 10A, and FIG. 11A illustrate magnetic flux diagrams for the respective electrical angles. FIG. 9B, FIG. 10B, and FIG. 11B illustrate magnetic flux density diagrams for the respective electrical angles. A magnetic flux diagram illustrates flows of magnetic fluxes, and line intervals in the magnetic flux diagram indicate an intensity of a magnetic flux. In addition, in FIG. 9A, FIG. 9B to FIG. 11A, and FIG. 11B, each of the three-phase reactors corresponds to the three-phase reactor illustrated in FIG. 7 being rotated by 30° clockwise.

Firstly, in the three-phase alternating current illustrated in FIG. 8, when an electrical angle is 0°, a magnetic flux diagram and a magnetic flux density diagram are as illustrated in FIG. 9A and FIG. 9B. In other words, it is found that the windings 11*c* and 13*c* of the winding core 1 have increased magnetic flux densities of the radial legs 11 and 13, and a large magnetic flux flows through the winding core 1. In addition, it is found that predetermined magnetic fluxes also flow through the respective winding cores 2 and 3, despite being smaller than the magnetic flux which flows through the winding core 1.

In contrary to this, it is found that no magnetic flux flows through a portion between the peripheral portions 12 and 22, 22 and 32, and 32 and 12 of adjacent two of the winding cores, i.e., a portion corresponding to each of the core fixing members 61, 62, and 63 which are respectively positioned between adjacent two of the winding cores 1, 2, and 3.

Next, in the three-phase alternating current illustrated in FIG. 8, when an electrical angle is 60°, a magnetic flux diagram and a magnetic flux density diagram are as illustrated in FIG. 10A and FIG. 10B. In other words, it is found that the windings 31*c* and 33*c* of the winding core 3 have increased magnetic flux densities of the radial legs 31 and 33, and a large magnetic flux flows through the winding core 3. In addition, it is found that predetermined magnetic fluxes also flow through the respective winding cores 1 and 2, despite being smaller than the magnetic flux which flows through the winding core 3.

In contrary to this, it is found that no magnetic flux flows through a portion between the peripheral portions 12 and 22, 22 and 32, and 32 and 12 of adjacent two of the winding cores, i.e., a portion corresponding to each of the core fixing members 61, 62, and 63 which are respectively positioned between adjacent two of the winding cores 1, 2, and 3.

In addition, in the three-phase alternating current illustrated in FIG. 8, when an electrical angle is 250°, a magnetic flux diagram and a magnetic flux density diagram are as illustrated in FIG. 11A and FIG. 11B. In other words, it is found that the windings 31*c* and 33*c* of the winding core 2 have increased magnetic flux densities of the radial legs 31 and 33, and a large magnetic flux flows through the winding core 3. In addition, it is found that a predetermined magnetic flux also flows through the winding core 2, despite being smaller than the magnetic flux which flows through the winding core 3. Further, it is found that a certain magnetic flux also flows through the winding core 1 as well, despite being smaller than the magnetic fluxes which flow through the winding cores 2 and 3.

In contrary to this, it is found that no magnetic flux flows through a portion between the peripheral portions 12 and 22, 22 and 32, and 32 and 12 of adjacent two of the winding cores, i.e., a portion corresponding to each of the core fixing members 61, 62, and 63 which are respectively positioned between adjacent two of the winding cores 1, 2, and 3.

FIG. 9A to FIG. 11B illustrate when an electrical angle is 0°, 60°, and 250°. However, the same applies to when an electrical angle is other than the above. No magnetic flux flows at all times through a portion corresponding to each of the core fixing members 61, 62, and 63 which are respectively positioned between adjacent two of the winding cores 1, 2, and 3. In FIG. 9A, FIG. 10A, and FIG. 11A, a portion corresponding to each of the core fixing members 61, 62, and 63 includes a single magnetic flux line. However, the fact that no magnetic flux flows despite the inclusion of the single line is also apparent from FIG. 9B, FIG. 10B, and FIG. 11B.

The first reason is based on the physical law that a magnetic flux passes through a route (e.g., winding cores 1, 2, and 3) which minimizes the magnetic energy formed by the magnetic flux as a whole reactor, i.e., a magnetic flux passes through a route which is the shortest on an identical core. In addition, the second reason is based on the use of the physical characteristic of, for example, a three-phase alternating current that, as understood by considering the central core 4, the sum of magnetic fluxes which is a total from the winding cores 1, 2, and 3 becomes zero at all times.

In this manner, in the sixth example illustrated in FIG. 7, no magnetic flux flows at all times through the core fixing members 61, 62, and 63 even when, for example, the core fixing members 61, 62, and 63 are formed integrally with the winding cores 1, 2, and 3 (with an identical material). Therefore, for example, it is also possible to form the holes 610, 620, and 630 on the core fixing members 61, 62, and 63, and to use the holes for assembling or fixing the three-phase reactor.

Further, the above-described examples can be appropriately combined. For example, it is needless to say that the fifth example illustrated in FIG. 6 can be applied to the sixth example illustrated in FIG. 7 to provide the gap member 7 having a thickness of d on the outside of the cylindrical-shaped central core 41. Alternatively, it is needless to say that the fifth example illustrated in FIG. 6 can be applied to the fourth example illustrated in FIG. 5 to provide the gap member 7 having a thickness of d on the outside of the hexagon-shaped central core 42. As has been described above in detail, the multi-phase reactor of each of the examples according to the present invention enables to obtain a constant inductance for each phase.

The multi-phase reactor according to the present invention has the effect of enabling to set a constant value of inductance for each phase.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that various changes, substitutions, and alterations could be made hereto without departing from the spirit and scope of the invention.

What is claimed is:

1. A multi-phase reactor comprising:
a first core arranged at a center of the reactor;
a plurality of second cores provided outside the first core and arranged so that each of magnetic paths with respect to the first core is in a loop shape; and
one or a plurality of windings wound around each of the second cores, wherein
each of the second cores includes two end portions opposite to the outside of the first core, the two end portions being located at different positions along the outside of the first core without contact between the two end portions and the outside of the first core.

2. The multi-phase reactor according to claim 1, wherein the second cores have an identical shape.

3. The multi-phase reactor according to claim 1, wherein the second cores are arranged around the first core in rotational symmetry with respect to a center of the first core.

4. The multi-phase reactor according to claim 1, wherein predetermined gaps are provided between outside of the first core and the second cores.

5. The multi-phase reactor according to claim 1, further comprising
a gap member provided between outside of the first core and the second cores and having a predetermined thickness.

6. The multi-phase reactor according to claim 1, wherein
each of the second cores is formed integrally including two radial legs each having one end facing outside of the first core and extending radially, and a peripheral portion connecting other ends of the two radial legs, and
each of the windings is wound around a corresponding one of the radial legs.

7. The multi-phase reactor according to claim 6, wherein
the outside of the first core has a circular shape corresponding to a shape at the one end of each of the radial legs of the plurality of second cores.

8. The multi-phase reactor according to claim 6, wherein
the outside of the first core has a polygonal shape corresponding to a shape at the one end of each of the radial legs of the plurality of second cores.

9. The multi-phase reactor according to claim 6, further comprising
core fixing members respectively provided between the peripheral portions of adjacent two of the second cores.

10. The multi-phase reactor according to claim 9, wherein
the core fixing members are made of a quality of a material different from that of the plurality of second cores.

11. The multi-phase reactor according to claim 9, wherein
the core fixing members are formed integrally with the plurality of second cores with an identical quality of a material.

12. The multi-phase reactor according to claim 9, wherein
the core fixing members and the peripheral portions of the second cores are formed as a circular shape.

13. The multi-phase reactor according to claim 9, wherein
the core fixing members are used for assembling or fixing the multi-phase reactor.

14. The multi-phase reactor according to claim 13, wherein
each of the core fixing members includes a predetermined hole.

15. The multi-phase reactor according to claim 1, wherein
the multi-phase reactor is a three-phase reactor to which a three-phase alternating current is applied.

16. The multi-phase reactor according to claim 15, wherein
the plurality of second cores of an integral multiple of three are provided, and
the windings wound around the second cores of the integral multiple of three are sorted into three.

* * * * *